US011118766B1

(12) United States Patent
Thompson et al.

(10) Patent No.: US 11,118,766 B1
(45) Date of Patent: Sep. 14, 2021

(54) FLUSH-MOUNTING FIXTURE MOUNTS

(71) Applicant: Lucifer Lighting Company, San Antonio, TX (US)

(72) Inventors: Ryan Thompson, Maynard, MA (US); Eric Miller, Sommerville, MA (US); Ben Karpen, San Antonio, TX (US); Daniel Garcia, San Antonio, TX (US); Chris Reed, San Antonio, TX (US)

(73) Assignee: LUCIFER LIGHTING COMPANY, San Antonio, TX (US)

( * ) Notice: Subject to any disclaimer, the term of this patent is extended or adjusted under 35 U.S.C. 154(b) by 0 days.

(21) Appl. No.: 16/810,381

(22) Filed: Mar. 5, 2020

(51) Int. Cl.

| | |
|---|---|
| ***F21V 21/03*** | (2006.01) |
| ***E04B 9/00*** | (2006.01) |
| ***F21V 17/10*** | (2006.01) |
| ***F21S 8/04*** | (2006.01) |
| ***F21V 21/02*** | (2006.01) |
| *F21S 8/00* | (2006.01) |

(52) U.S. Cl.
CPC ..... *F21V 21/03* (2013.01); *E04B 9/006* (2013.01); *F21S 8/043* (2013.01); *F21V 17/104* (2013.01); *F21S 8/036* (2013.01); *F21V 21/02* (2013.01)

(58) Field of Classification Search
CPC . E04B 9/006; F21S 8/026; F21S 8/036; F21S 8/043; F21V 17/104; F21V 21/02; F21V 21/03; F21V 21/0832; F21V 23/04
See application file for complete search history.

(56) References Cited

U.S. PATENT DOCUMENTS

| | | | | |
|---|---|---|---|---|
| 1,270,296 | A * | 6/1918 | Jeune | F21V 21/02 248/345 |
| 4,929,187 | A * | 5/1990 | Hudson | F21V 21/03 439/334 |
| 10,122,140 | B1 * | 11/2018 | Vega-Perez | F21V 21/03 |
| 10,756,453 | B2 * | 8/2020 | Kimmel | H01R 4/56 |
| 2002/0111063 | A1 * | 8/2002 | Kerr | F04D 29/601 439/545 |
| 2011/0141741 | A1 * | 6/2011 | Engstrom | F21V 21/04 362/257 |
| 2019/0234593 | A1 * | 8/2019 | Stevens | H01R 13/73 |

* cited by examiner

*Primary Examiner* — Leah Simone Macchiarolo
(74) *Attorney, Agent, or Firm* — Norton Rose Fulbright US LLP

(57) ABSTRACT

Some fixture mounts include a body that is couplable to a structure, the body having an upper surface, a lower surface, and a peripheral surface that connects the upper and lower surfaces and defines one or more ledges, wherein the body is couplable to a fixture such that each of first and second protruding features of the fixture is received between one of the ledge(s) and the upper surface. In some fixture mounts, the protruding features are slidable along the ledge(s) above which they are received such that the fixture is rotatable relative to the body. In some fixture mounts, at least one of the ledge(s) is tapered such that, as a protruding feature of the fixture that is received above the ledge is moved toward the ledge, the fixture is urged toward the upper surface.

20 Claims, 9 Drawing Sheets

FLUSH-MOUNTING FIXTURE MOUNTS

BACKGROUND

1. Field of the Invention

The present invention relates generally to mounts for securing a fixture (e.g., a light fixture) relative to a structure (e.g., a ceiling), fixtures for use with the same, and related methods.

2. Description of Related Art

There is often a need to mount a fixture, such as a light fixture, fan, or the like, to a structure, such as a ceiling, wall, floor, or the like. But traditional mounts for accomplishing such mounting suffer from a number of disadvantages. For one, some such mounts require the fixture to be handled while multiple fasteners are used to couple the fixture to the mount, which is cumbersome, particularly when attempting to mount the fixture to a ceiling. Further, some traditional mounts may provide for little to no post-mounting adjustment of the fixture's position relative to the structure, either limiting or preventing such adjustment altogether or requiring the fixture itself to provide for it. Finally, some such mounts may be incapable of achieving certain mounting relationships, such as a flush-mount between the fixture and the structure, due to, for example, the space required to allow installation of fasteners between the fixture and the mount, how those fasteners join the fixture and the mount (e.g., being received through the fixture and into threaded openings of the mount), and/or the like.

SUMMARY

The present fixture mounts can each address one or more of these disadvantages. To illustrate, some of the present fixture mounts, at least via including a peripheral surface that defines one or more ledges, each for supporting a protruding feature of a fixture, can allow for coupling of the fixture to the mount with a reduced number of—in some mounts, one—fastener. To illustrate, a first, fixed protruding feature of the fixture (e.g., a ledge) can be supported by one of the one or more ledges, while a second, movable protruding feature (e.g., a fastener) is moved to be supported by one of the one or more ledges. In some such fixture mounts, the one or more ledges can each extend around the mount such that, after the fixture is coupled to the mount, the fixture can be rotated relative to the mount by an angle of at least 10 degrees (e.g., at least 90, 180, or 350 degrees), providing for post-mounting adjustment of the fixture's position relative to the mount. Additionally or alternatively, in some such fixture mounts, at least one of the one or more ledges can be tapered such that, as a movable protruding feature (e.g., a fastener) of the fixture that is supported by the ledge is moved toward the ledge, the fixture is urged toward the structure to which the mount is coupled, facilitating flush-mounting of the fixture to the structure.

Some of the present fixtures mounts comprise a body configured to be coupled to a structure, and some of the present methods comprise coupling the body to the structure. The body, in some embodiments, has an upper surface that faces the structure when the body is coupled to the structure. In some embodiments, the body has a lower surface that is opposite to the upper surface and a peripheral surface that connects the upper and lower surfaces. The peripheral surface, in some embodiments, defines one or more ledges, each extending around at least a portion of the body. Each of the one or more ledges, in some embodiments, is positioned such that a circular arc about the central axis, the circular arc overlying the ledge and subtending at least 10 degrees, optionally at least 90 degrees, does not intersect the body. In some embodiments, at least one of the one or more ledges has a tapered surface positioned such that a distance, measured perpendicular to the central axis, between the central axis and the tapered surface increases along a direction from the upper surface to the lower surface.

For some fixture mounts, the body is configured to be coupled to a fixture, and some methods comprise coupling the fixture to the body. Some fixture mounts comprise the fixture. In some embodiments, when the body is coupled to the fixture, a first protruding feature of the fixture is received between one of the one or more ledges and the upper surface on a first side of a plane that includes a central axis of the body and/or a second protruding feature is received between one of the one or more ledges and the upper surface on a second side of the plane that is opposite to the first side. In some embodiments, the fixture comprises a base and the first protruding feature and/or the second protruding feature are configured to be coupled—and, in some embodiments, are coupled to—the base. In some embodiments, the base defines a recess into which the first and second protruding features are configured to extend. In some embodiments, when the body is coupled to the fixture, at least a portion of the body is received by the recess. The fixture, in some embodiments, comprises a light fixture having an emitter housing that is coupled to the base. In some embodiments, when the body is coupled to the fixture, the emitter housing is rotatable relative to the base about an axis that is perpendicular to the central axis of the body.

The first and second protruding features, in some embodiments, are slidable along the one or more ledges above which they are received such that the fixture is rotatable relative to the body about the central axis of the body by an angle of at least 10 degrees, optionally at least 90 degrees. Some methods comprise rotating the fixture relative to the body about the central axis of the body by an angle of at least 10 degrees, optionally at least 90 degrees, such that the first and second protruding features slide along the one or more ledges above which they are received.

In some embodiments, the one or more ledges comprise a first ledge and a second ledge that is positioned closer to the upper surface than is the first ledge. In some of such embodiments, the body is configured to be coupled to the fixture such that the first protruding feature is received between the first ledge and the upper surface and/or the second protruding feature is received between the second ledge and the upper surface. At least a portion of the first ledge, in some embodiments, is disposed on the first side of the plane that include the central axis of the body. At least a portion of the second ledge, in some embodiments, is disposed on the second side of the plane.

In some embodiments, when the body is coupled to the fixture, the first protruding feature is movable relative to the base between a first position and a second position in which the first protruding feature is closer to the central axis of the body than when the first protruding feature is in the first position. Some methods comprise moving the first protruding feature relative to the base of the fixture from the first position to the second position. In some embodiments in which at least one of the one or more ledges has a tapered surface, when the body is coupled to the fixture the first protruding feature is received between one of the one or more ledges having a tapered surface and the upper surface such that, as the first protruding feature is moved toward the second position, the fixture is urged toward the upper surface. In some embodiments, when the first protruding feature is in the second position, the first protruding feature resists rotation of the fixture relative to the body about the central axis of the body more so than when the first protruding feature is in the first position. The first protruding feature, in some embodiments, comprises a fastener. The second protruding feature, in some embodiments, is coupled in fixed relation to the base of the fixture. In some methods, coupling the fixture to the body is performed such that (1) the second protruding fixture is received above one of the one or more ledges and (2) the first protruding feature is moved from the first position toward the second position to be received above one of the one or more ledges.

The structure, in some embodiments, comprises a junction box. Coupling the body to the structure, in some of such embodiments, comprises inserting a fastener through the body and into an opening of the junction box.

The term "coupled" is defined as connected, although not necessarily directly, and not necessarily mechanically. Two items that are "coupled" may be unitary with each other or may be separated by one or more intermediate components or elements. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed configuration, the terms "substantially" and "approximately" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and containing") are open-ended linking verbs. As a result, an apparatus that "comprises," "has," "includes," or "contains" one or more elements possesses those one or more elements, but is not limited to possessing only those one or more elements. Likewise, a method that "comprises," "has," "includes," or "contains" one or more steps possesses those one or more steps, but is not limited to possessing only those one or more steps.

Any configuration of any of the apparatuses, systems, and methods can consist of or consist essentially of—rather than comprise/have/include/contain—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one configuration may be applied to other configurations, even though not described or illustrated, unless expressly prohibited by this disclosure or the nature of the configurations.

Some details associated with the configurations described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the configuration depicted in the figures, however it should be understood that modifications to the relative scale of the depicted elements could be made without departing from the scope or content of the present invention.

DETAILED DESCRIPTION

Figure 1B:
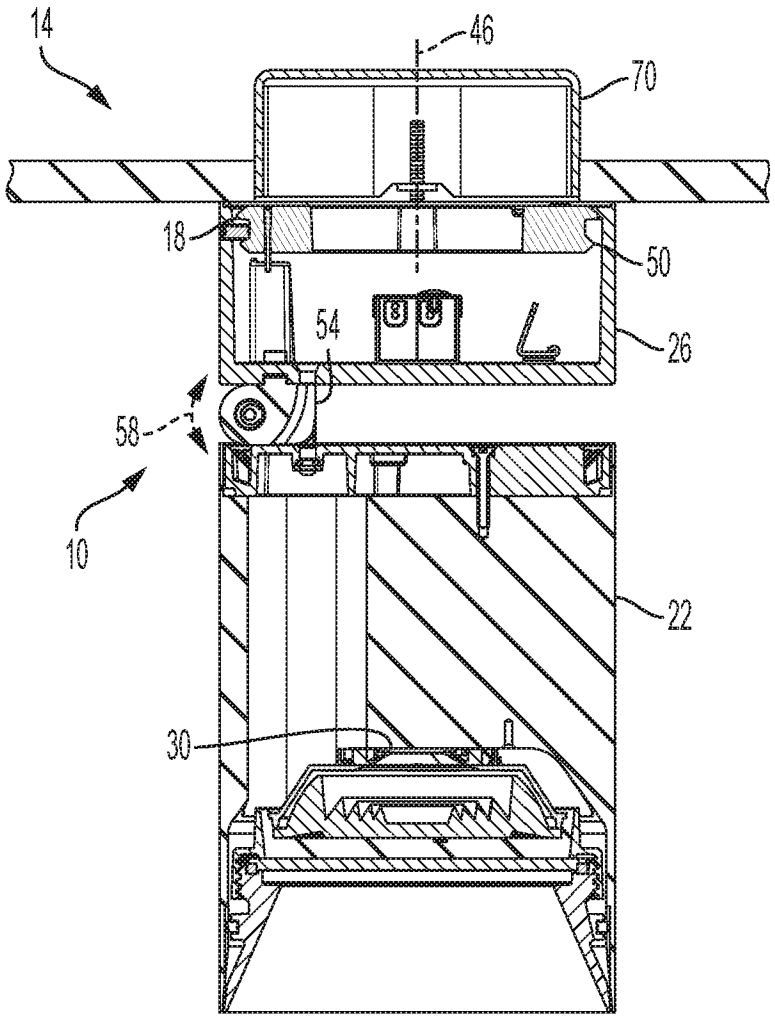
FIG. 1B is a cross-sectional side view of the fixture, fixture mount, and junction box of FIG. 1A, taken in the plane of FIG. 1A's page.
Figure 1A:
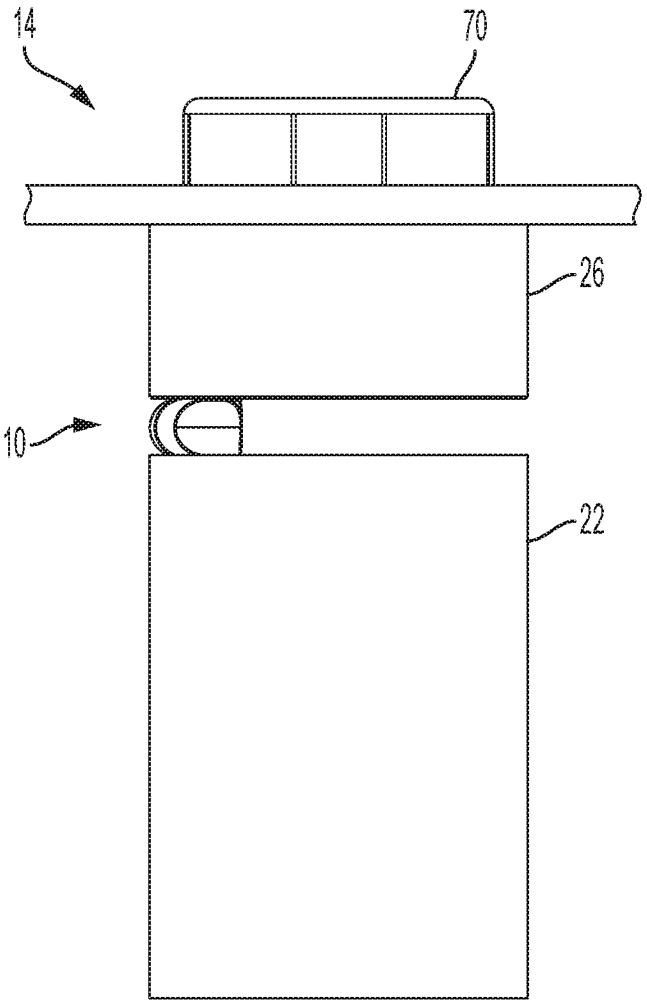
FIG. 1A is a side view of one of the present fixtures coupled to a junction box using one of the present fixture mounts.

Referring to FIGS. 1A and 1B, shown is a light fixture 10 that is coupled to a structure 14 using one of the present fixture mounts 18. Fixture 10 can comprise an emitter housing 22 and a base 26 that is configured to be coupled to fixture mount 18 as described in further detail below. Emitter housing 22 can house one or more components of fixture 10, such as one or more light sources 30 (e.g., one or more light-emitting diodes (LEDs) and/or one or more incandescent, fluorescent, or halide lamps) such that light emitted from the one or more light sources can pass through an opening 42 of the emitter housing. Emitter housing 22 can, but need not, be rotatable relative to base 26 about a central axis 46 of fixture mount 18's body 50 and/or about an axis that is substantially perpendicular to the body's central axis, optionally by an angle that is greater than or equal to any one of, or between any two of, 10°, 20°, 30°, 40°, 50°, 60°, 70°, 80°, or 90°. For example, as shown in FIGS. 1A and 1B, emitter housing 22 is pivotally coupled to base 26 with a hinge 54 that defines the axis about which the emitter housing can rotate (e.g., as illustrated by arrow 58). The adjustability of fixture 10 can be important to achieve a desired orientation thereof, such as to direct emitted light in a desired direction. While in the embodiment shown emitter housing 22 and base 26 are separate structures of fixture 10, in other embodiments the base can be part of (e.g., coupled in fixed relation to) the emitter housing. Light fixture 10 is provided solely by way of illustration, as the present fixture mounts (e.g., 18) can be used to couple any suitable fixture to structure 14 (e.g., a junction box 70, described in further detail below), including a fan, a decorative object, or the like.

Figure 2A:
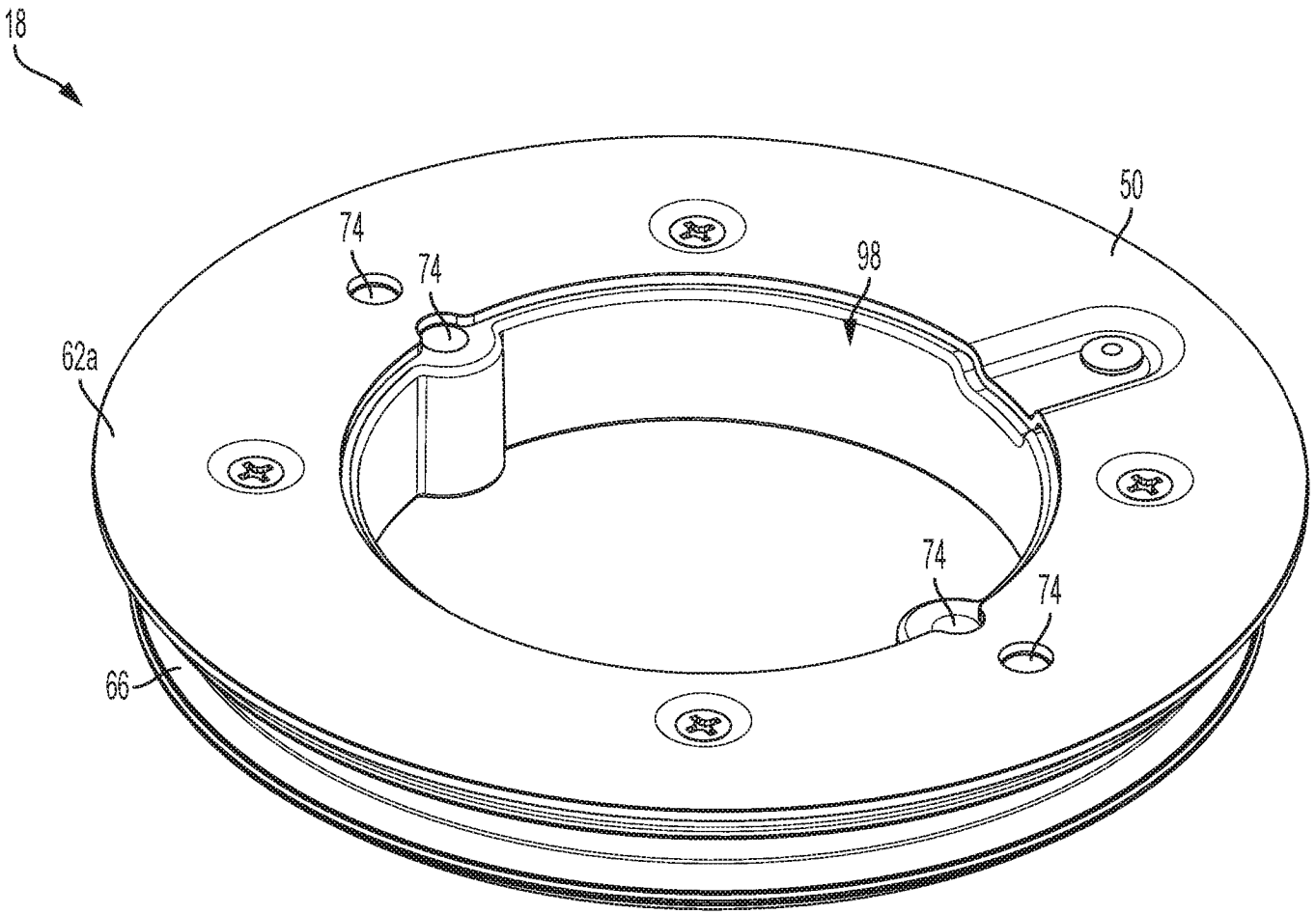
FIG. 2A is a perspective view of the fixture mount of FIGS. 1A and 1B.
Figure 2C:
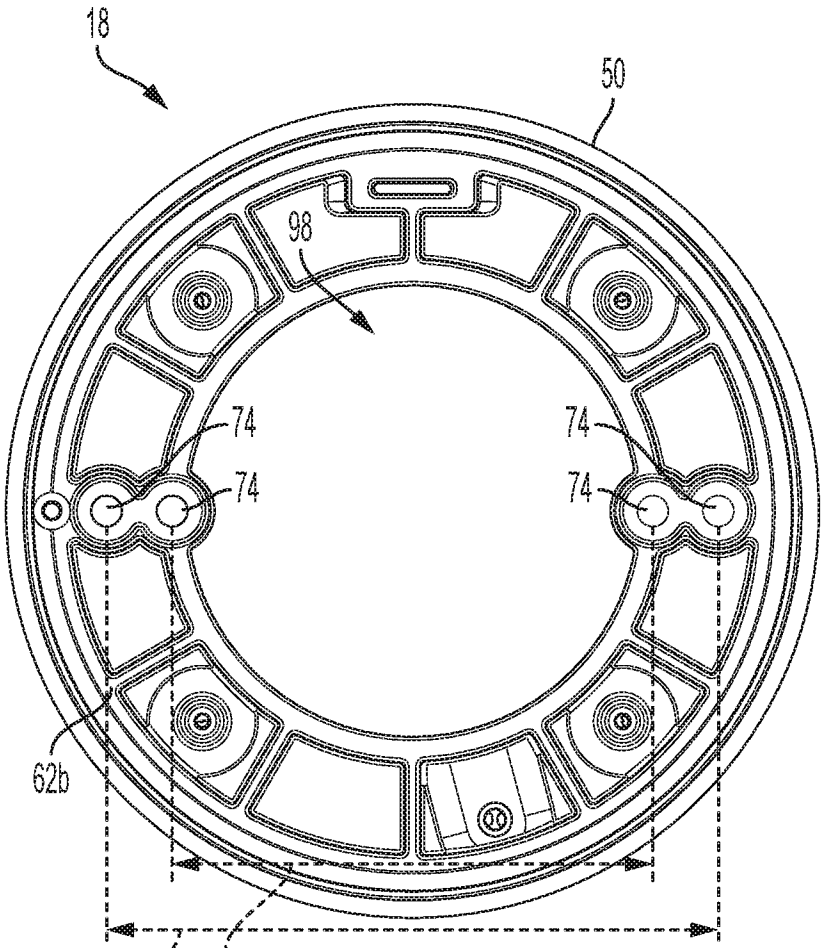
FIGS. 2B and 2C are top and bottom views, respectively, of the fixture mount of FIGS. 1A and 1B.
Figure 2B:
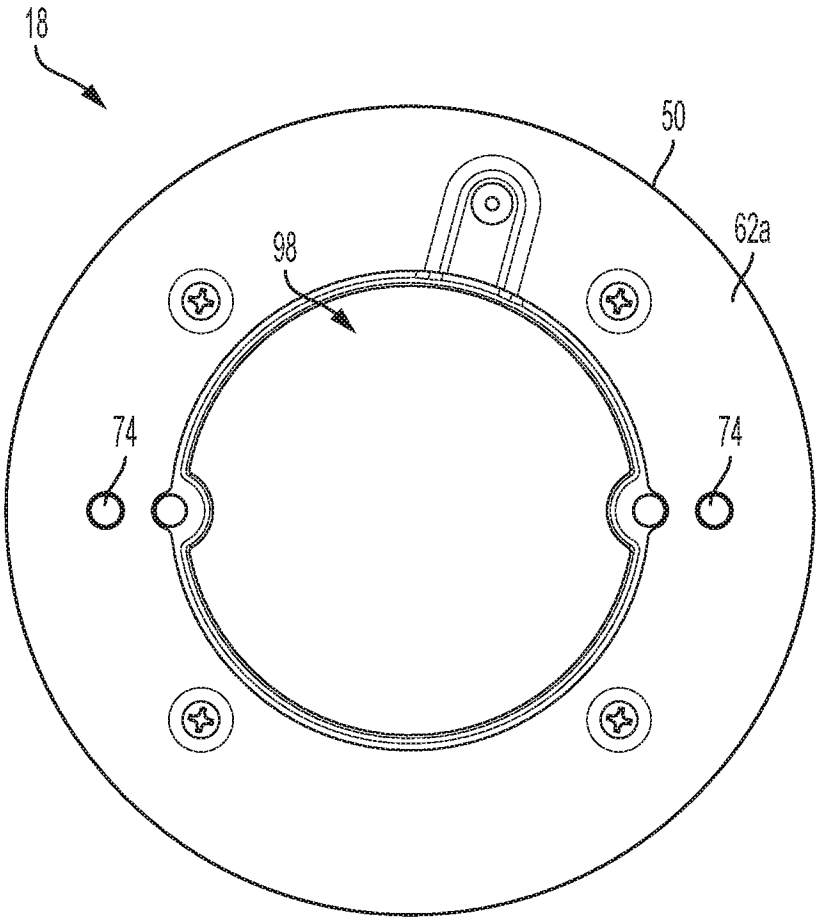

FIGS. 2A-2C show fixture mount 18 of FIGS. 1A and 1B. Fixture mount 18 can comprise a body 50—which can be a single-piece or a multi-piece body—that has opposing upper and lower surfaces 62*a* and 62*b* connected by a peripheral surface 66 and is configured to be coupled to structure 14 (e.g., such that upper surface 62*a* faces the structure). Structure 14 can comprise any suitable structure, including, but not limited to, a junction box, ceiling, wall, floor, light track, table, and/or the like. Body 50 can be coupled to structure 14 before fixture 10 is coupled to the body, which—in combination with the below-described geometric features of the body—can facilitate mounting of the fixture (e.g., because fixing the body, which may be less bulky than the fixture, to the structure can be easier than doing the same with the fixture alone, particularly when the fixture's position may need to be adjusted relative to the structure).

Figure 3B:
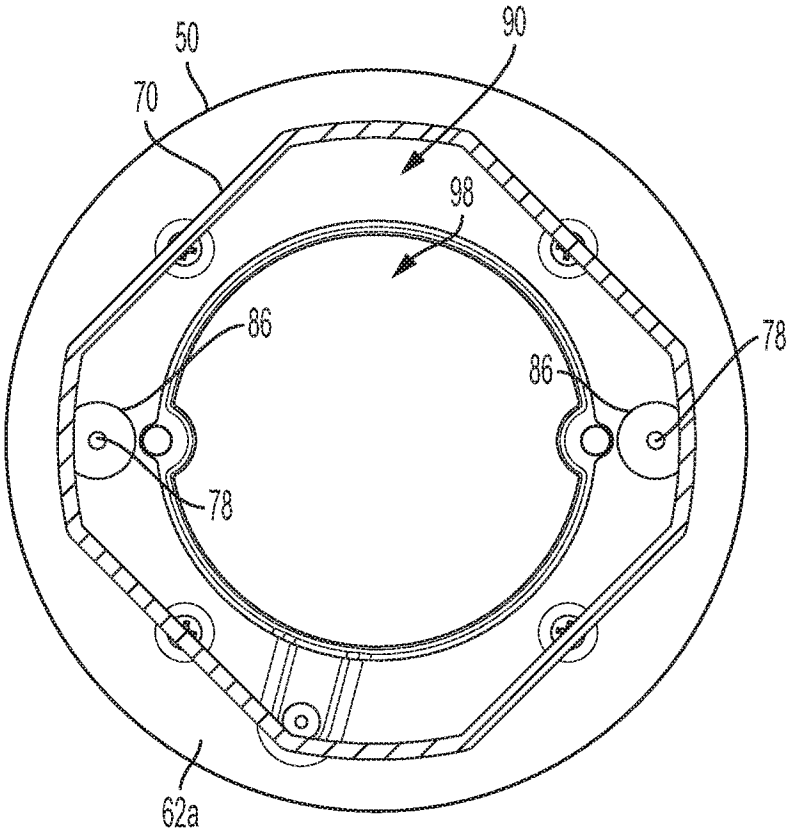
FIGS. 3A and 3B are perspective and top views, respectively, of the fixture mount and junction box of FIGS. 1A and 1B, with the top of the junction box not being shown in FIG. 3B.
Figure 3A:
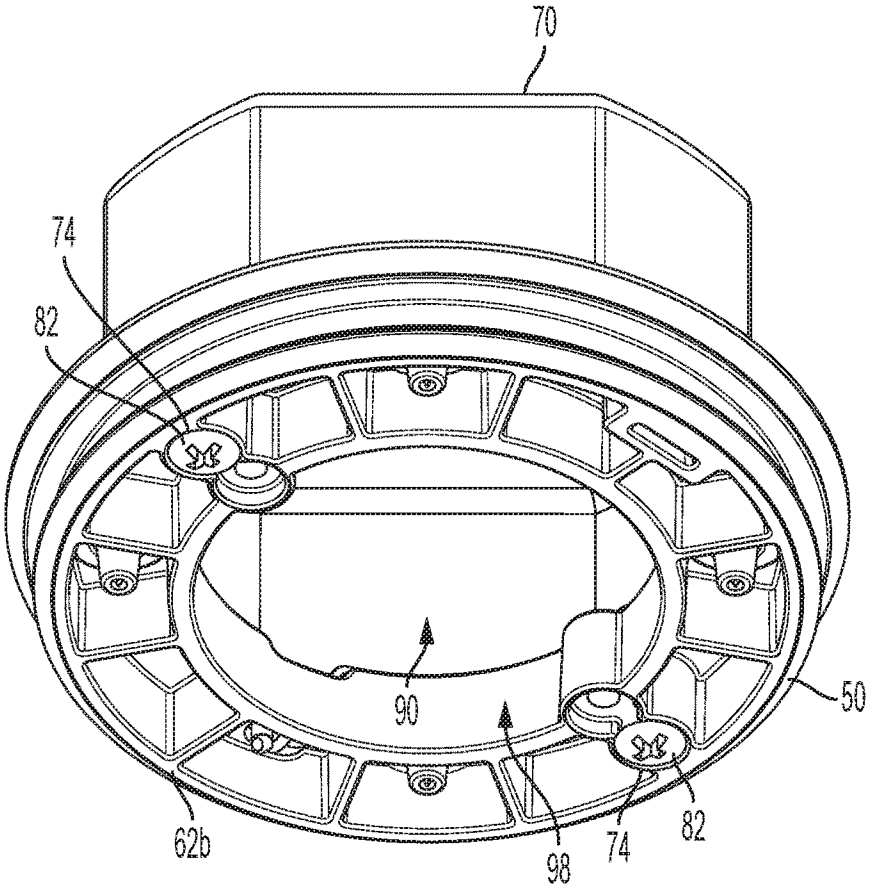

To illustrate, and referring additionally to FIGS. 3A and 3B, body 50 can be configured to be coupled to a junction box 70. Junction box 70 may generally be a metal or plastic enclosure that can house electrical wiring and/or connections. To effect coupling to junction box 70, body 50 and junction box 70 can each define one or more—optionally two or more—openings 74 and 78, respectively. At least one—optionally at least two—of body 50's one or more openings 74 can be positioned to align with a respective one of junction box 70's one or more openings 78 such that a fastener 82 (e.g., a screw, bolt, or clip) can be inserted through the body's opening and into the junction box's opening, thereby coupling the body to the junction box. For compactness, junction box 70 can include one or more tabs 86, each defining at least one of one or more openings 78 and extending into a cavity 90 defined by the junction box. Junction box 70 is provided solely by way of example—the present fixture mounts (e.g., 18) can be coupled to a structure (e.g., 14) without a junction box. To illustrate, fixture mount 18 can be coupled to a ceiling, wall, or floor via one or more fasteners disposed through one or more openings 74 of body 50 and into the ceiling, wall, or floor.

Body 50's one or more openings 74 can be positioned such that the body can be coupled to different junction boxes in the above-described manner. For example, body 50 can comprise three or more—optionally four or more—openings 74, wherein two or more pairs of the openings have different spacing between their openings. To illustrate, measured perpendicular to central axis 46, a first pair of openings 74 can be separated by a first transverse distance 94*a* (e.g., measured between the centers of the openings) and a second pair of the openings (which can, but need not, include one of first pair's openings) can be separated by a second transverse distance 94*b* (e.g., measured between the centers of the openings) that is smaller than the first transverse distance (FIG. 2C). In this manner, the first pair of openings 74 can be used to couple body 50 to a junction box 70 having two openings 78 spaced apart by first transverse distance 94*a*, while the second pair of openings can be used to couple the body to a junction box having two openings spaced apart by second transverse distance 94*b*. For any pair of body 50's openings 74 or junction box 70's openings 78, the transverse distance (e.g., 94*a* or 94*b*) between the openings can be approximately 2.75 to 3.5 inches (e.g., approximately 2.75 inches or approximately 3.5 inches). Similar functionality can be achieved where openings 74 are slots through which fasteners 82 can be received by openings 78 of a junction box 70 that spaced apart by first transverse distance 94*a* or by openings 78 of a junction box 70 that spaced apart by second transverse distance 94*b*.

Body 50 can also define a central opening 98 such that, when the body is coupled to junction box 70 and fixture 10 is coupled to the body, one or more components of the fixture (e.g., one or more wires configured to deliver power to the fixture) can pass through the central opening into cavity 90 defined by the junction box. Central opening 98 can be relatively large to facilitate passage of the one or more components, e.g., an area of the central opening can be greater than or equal to any one of, or between any two of, 15%, 25%, 35%, 45%, 55%, or 65% of an area defined by the perimeter of body 50.

Figure 4A:
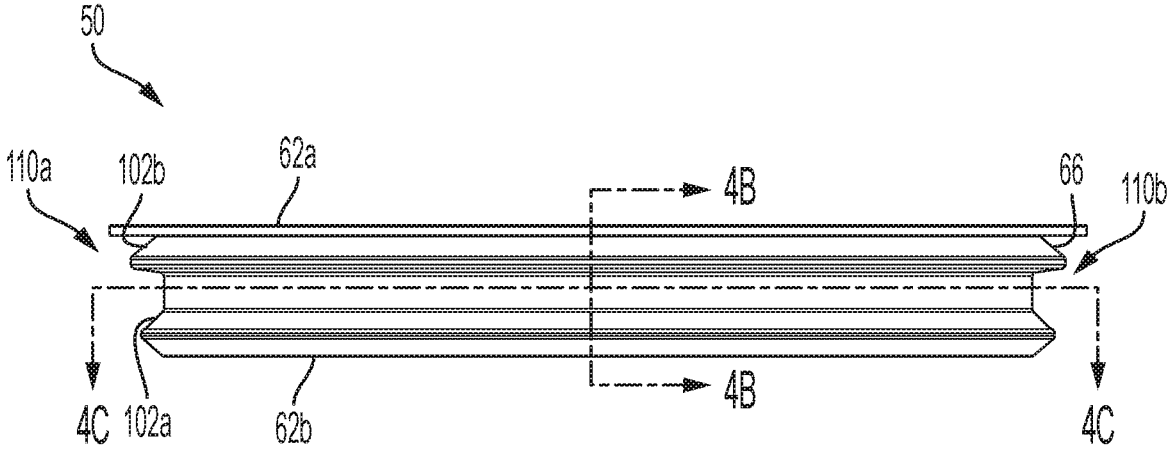
FIG. 4A is a side view of the fixture mount of FIGS. 1A and 1B.
Figure 4B:
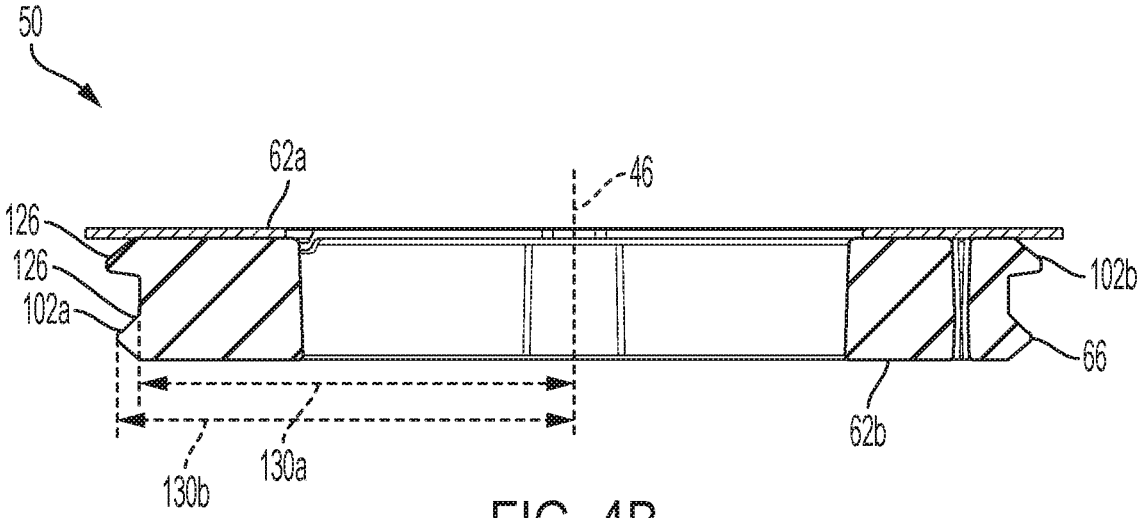
FIG. 4B is a cross-sectional side view of the fixture mount of FIGS. 1A and 1B, taken along line 4B-4B of FIG. 4A.
Figure 4C:
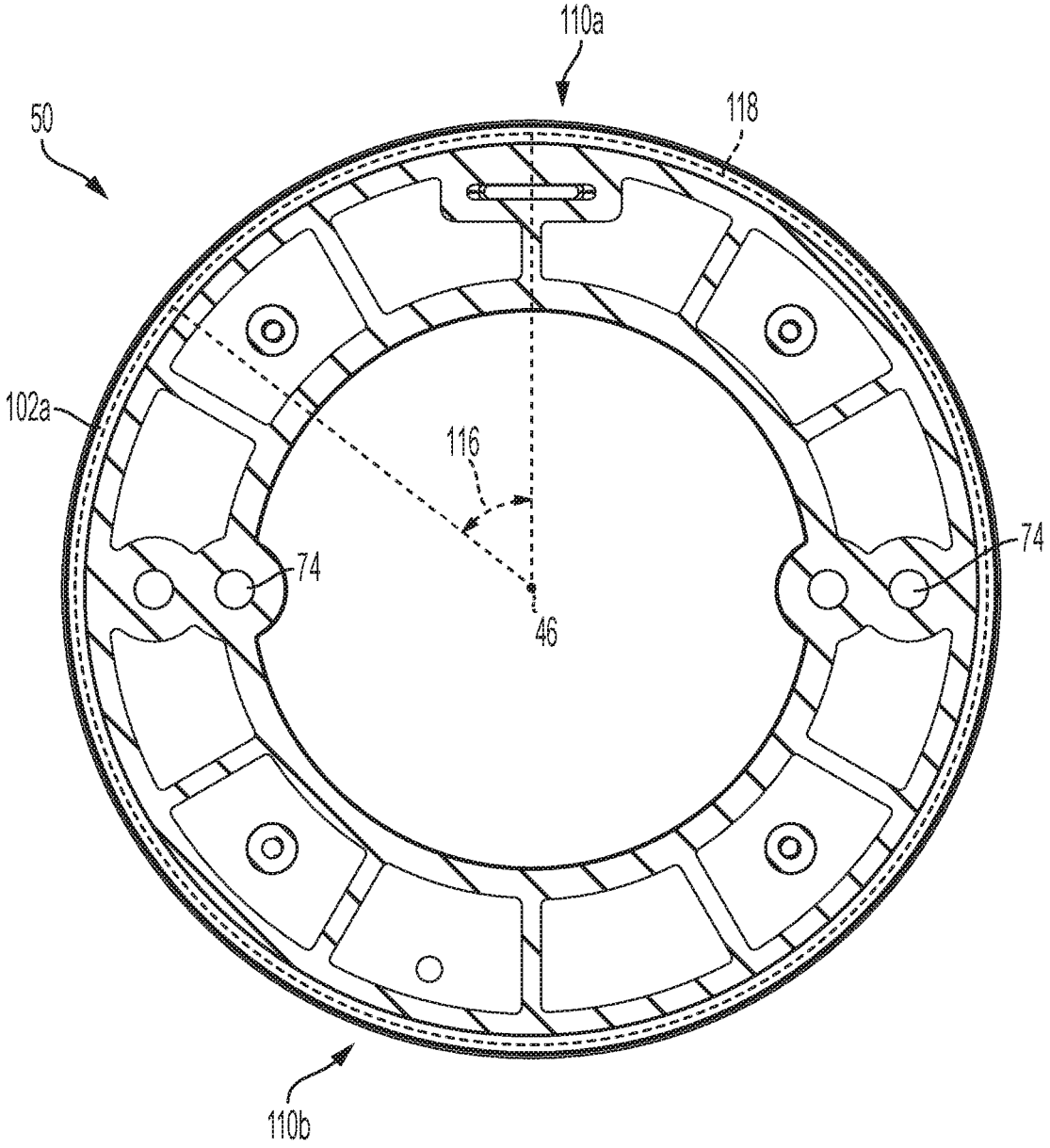
FIG. 4C is a cross-sectional top view of the fixture mount of FIGS. 1A and 1B, taken along line 4C-4C of FIG. 4A.

Referring to FIGS. 4A-4C, the geometry of body 50 can facilitate mounting of fixture 10 thereto (e.g., after the body is coupled to structure 14). Peripheral surface 66 of body 50 may define one or more—optionally two or more—ledges (e.g., 102*a* and 102*b*) that each extends around at least a portion of the body. In the illustrated embodiment, ledges 102*a* and 102*b* extend around the entire perimeter of the peripheral surface 66. As will be described in more detail below, embodiments of body 50 may have one or more ledges (e.g., 102*a* and 102*b*), at least one—up to and including each—of which extends around only a portion of the perimeter of peripheral surface 66.

Figure 5B:
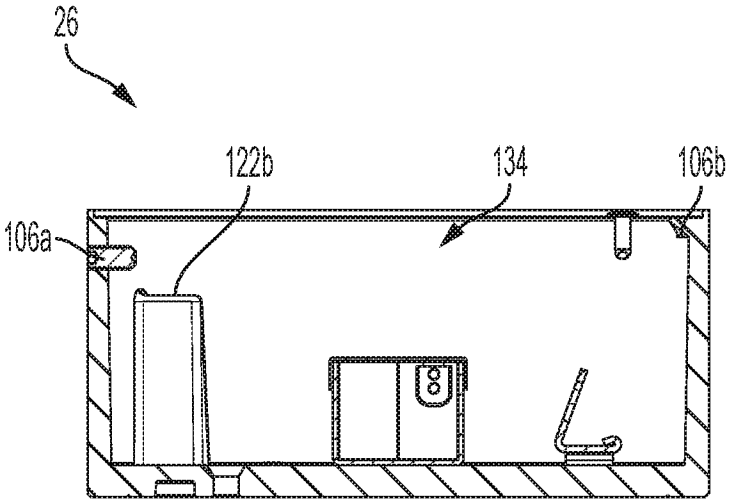
FIG. 5B is a cross-sectional side view of the base of the fixture of FIGS. 1A and 1B, taken along line 5B-5B of FIG. 5A.
Figure 5A:
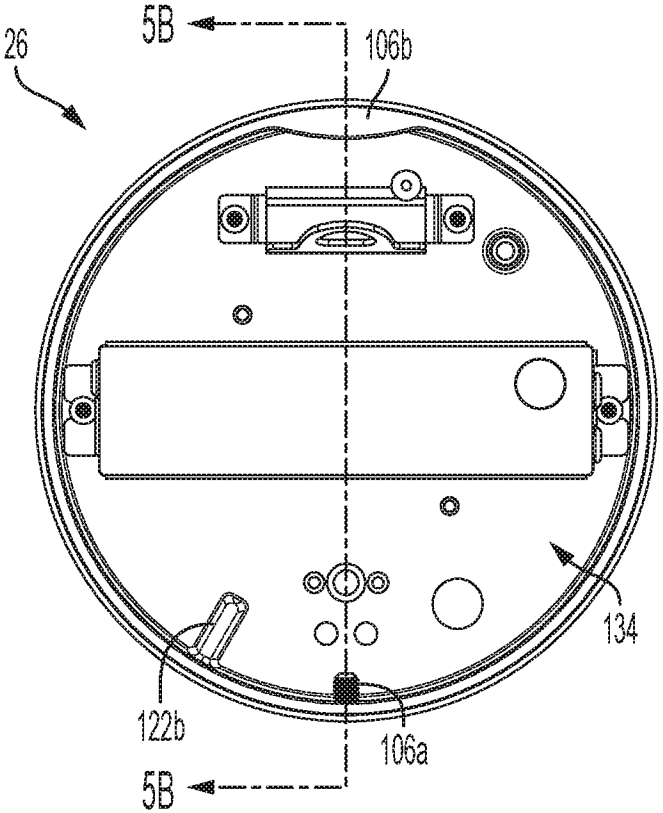
FIG. 5A is a top view of a base of the fixture of FIGS. 1A and 1B.

Turning to FIGS. 5A and 5B, base 26 may include first and second protruding features 106*a* and 106*b*. In the illustrated embodiment, protruding feature 106*a* is a set-screw and protruding feature 106*b* is a tab, however, the first and second protruding features each can comprise other components, such as, for example, a bolt or pin (e.g., a locking pin). In general, it may be beneficial to have one protruding feature (e.g., second protruding feature 106*b*) that is static (i.e., not adjustable) and one protruding feature (e.g., first protruding feature 106*a*) that is adjustable. As will be described further, such a combination of protruding features may facilitate coupling of fixture 10 to body 50 with a single adjustment mechanism.

Figure 6B:
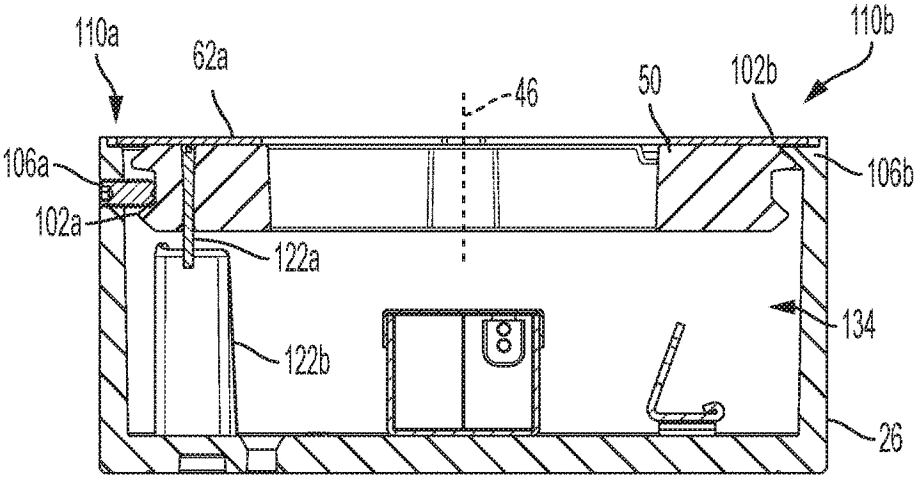
FIG. 6B is a cross-sectional side view of the fixture mount and the base of the fixture of FIGS. 1A and 1B coupled to one another, taken along line 6B-6B of FIG. 6A. The top plate of the fixture mount's body is not removed in FIG. 6B.
Figure 6A:
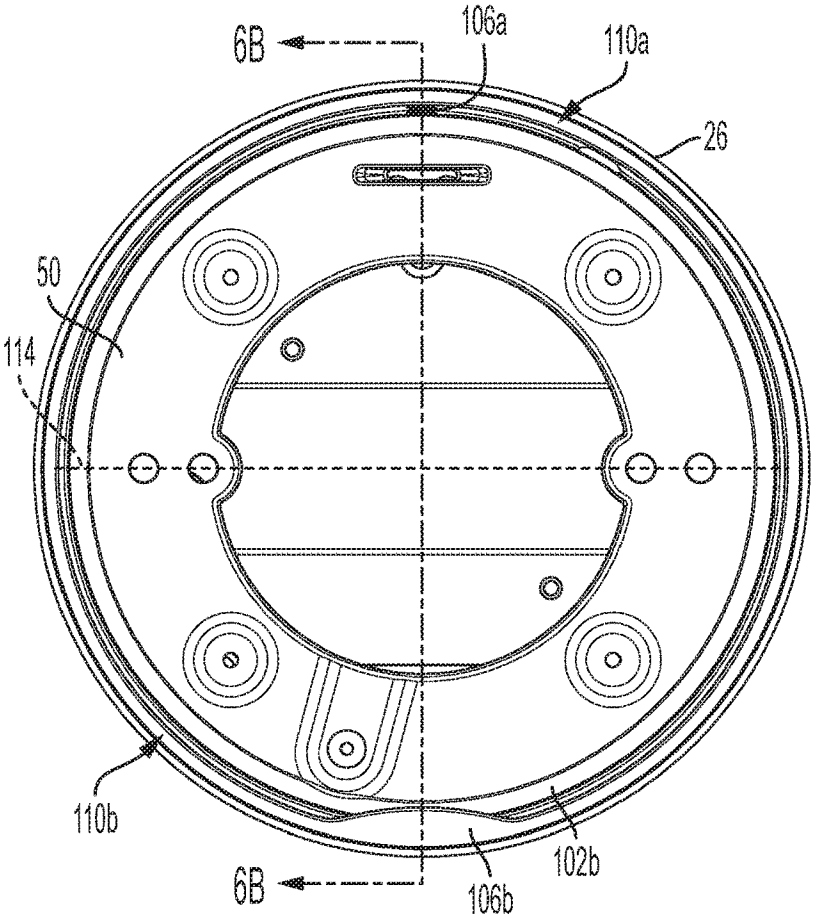
FIG. 6A is a top view of the fixture mount and the base of the fixture of FIGS. 1A and 1B coupled to one another, with the top plate of the fixture mount's body removed to provide a view of one of the base's protruding features disposed on one of the body's ledges.

Referring further to FIGS. 6A and 6B, illustrations of body 50 coupled to base 26 are provided. When so coupled, second protruding feature 106*b* can be received between one of the one or more ledges (e.g., second ledge 102*b*) and upper surface 62*a* of the body (FIG. 6B). First protruding feature 106*a* can be received between one of the one or more ledges (e.g., first ledge 102*a*) and the upper surface 62*a*. The one or more ledges (e.g., 102*a* and 102*b*) can be positioned such that at least a portion of each of the one or more ledges may support at least one protruding feature (e.g., 106*a* or 106*b*). In this manner, fixture 10 may be coupled to body 50.

In certain applications, protruding features 106*a* and 106*b* may be disposed on opposing sides of body 50 (e.g., which can be opposing first and second sides of a plane 114 that includes central axis 46). This may facilitate balanced loading of body 50 and flush mounting of fixture 10 when body 50 is coupled to a structure such as a ceiling. More particularly, when body 50 includes first and second ledges 102*a* and 102*b*, at least a portion of first ledge 102*a* can be disposed on first side 110*a* and at least a portion of second ledge 102*b* can be disposed on second side 110*b*.

Protruding features 106*a* and 106*b* can be supported by the same one of the one or more ledges or—if body 50 includes at least first and second ledges 102*a* and 102*b*—by different ones of the ledges. For example, as shown in FIGS. 6A and 6B, protruding features 106*a* and 106*b* can be supported by different ledges 102*a* and 102*b* when fixture 10 is coupled to body 50, with the first protruding feature disposed above the first ledge and the second protruding feature disposed above the second ledge. Second ledge 102*b* can, but need not, be positioned closer to upper surface 62*a* than is first ledge 102*a*, which can facilitate mounting as described in further detail below.

The geometry of the one or more ledges (e.g., 102*a* and 102*b*) can further facilitate mounting at least by (1) permitting fixture 10 to rotate relative to body 50 when the fixture is coupled thereto and/or (2) urging the fixture toward structure 14 during mounting.

To permit rotation of fixture 10, the one or more ledges (e.g., 102*a* and 102*b*) can be positioned such that body 50 defines one or more spaces that each can receive a protruding feature (e.g., 106*a* and 106*b*) of the fixture such that the received protruding feature—and thus the fixture—can slide relative to body 50 while being supported by one of the one or more ledges. For example, referring particularly to FIG. 4C, each of the one or more ledges can be positioned such that body 50 is not intersected by a circular arc 118 about central axis 46 that overlies the ledge. In this manner, a protruding feature (e.g., 106*a* or 106*b*) received between a ledge (e.g., 102*a* or 102*b*) and upper surface 62*a* of body 50 can slide on the ledge along circular arc 118, thereby permitting fixture 10 to rotate about body 50's central axis 46.

The one or more ledges (e.g., 102*a* and 102*b*) can, alone or in combination with other components, define the amount by which base 26 can rotate about central axis 46. For each of the one or more ledges, circular arc 118 can subtend—and fixture 10, when coupled to body 50, may be rotatable about central axis 46 by—an angle (e.g., measured about the central axis as illustrated by arrow 116) that is greater than or equal to any one of, or between any two of, 10°, 30°, 60°, 90°, 120°, 150°, 180°, 210°, 240°, 270°, 300°, 330°, or 360° (e.g., at least 90°). In the embodiment shown in FIGS. 4A-4C, for each of first and second ledges 102*a* and 102*b*, circular arc 118 subtends 360°, with ledges 102*a* and 102*b* extending around the entirety of body 50. Fixture mount 18 and base 26 can also include first and second stops 122*a* and 122*b* (FIG. 6B), respectively, positioned such that fixture 10 cannot rotate relative to body 50 about central axis 46 by an angle that is larger than a stop angle. The stop angle can be less than or equal to any one of or between any two of 370°, 360°, 330°, 300°, 270°, 240°, 210°, 180°, 150°, 120°, or 90°. For example, first stop 122*a* can be configured to engage second stop 122*b* when fixture 10 has been rotated by an angle that is less than or equal to the stop angle in a clockwise and/or counterclockwise direction. First and second stops 122*a* and 122*b* each can be fixed relative to body 50 and base 26, respectively, to limit further rotation of fixture 10 in the rotation direction when the first stop engages the second stop, even if the one or more ledges might otherwise permit further rotation (e.g., the rotation angle at which the stops are engaged can be the stop angle). Alternatively, at least one of first stop 122*a* and second stop 122*b* can be movable (e.g., pivotable) relative to body 50 and base 26, respectively, such that when the first stop engages the second stop at least one of the stops can move (e.g., pivot) to permit a limited amount of further rotation of fixture 10 in the rotation direction (e.g., by an angle that is less than or equal to 10°). Incorporating such movable first and/or second stops 122*a* and 122*b* may allow fixture 10 to rotate by at least 360° about central axis 46—thereby promoting adjustability—while still preventing rotation beyond the stop angle (e.g., such that the stop angle is at least 360°). Limiting rotation of fixture 10 can mitigate the risk of damage thereto, such as damage to wires and/or connections of the fixture that might result when the fixture is rotated too much (e.g., due to twisting of the wires).

Such rotatable coupling of fixture 10 to body 50 may facilitate installation of the fixture on structure 14. For example, once protruding feature 106*b* is received by a ledge (as illustrated, ledge 102*b*), protruding feature 106*a* may be adjusted to a position wherein it is also received by a ledge (as illustrated, ledge 102*a*) but does not fully engage with peripheral surface 66 so as to lock or unduly restrict the rotation of base 26 relative to body 50. Because the one or more ledges (e.g., 102*a* and 102*b*) can support first and second protruding features 106*a* and 106*b* of fixture 10, the installer need not support the full weight of the fixture herself/himself when rotating it to the desired orientation, thus making it easier to do so. This can be particularly useful for fixtures that—like fixture 10 in FIGS. 1A and 1B—have an emitter housing 22 rotatable (e.g., pivotable) relative to a base 26 about a single axis of rotation, where rotation of the fixture relative to body 50 can be an additional degree of freedom by which the fixture can be oriented as desired.

To urge fixture 10 toward structure 14 during mounting, at least one of the one or more ledges (e.g., 102*a* and 102*b*) can have a tapered surface 126, whether or not the one or more ledges permit rotation of the fixture as described above. In the embodiment of body 50 shown in FIGS. 4A-4C, each of first and second ledges 102*a* and 102*b* has a tapered surface 126. Tapered surface 126 can be positioned such that a distance, measured perpendicular to central axis 46, between the central axis and the tapered surface increases along a direction from upper surface 62*a* to lower surface 62*b*. For example, that distance can increase from a first distance 130*a* to a second distance 130*b* that is greater than or equal to any one of, or between any two of, 101%, 114%, 103%, 104%, 105%, 106%, 107%, 108%, 109%, or 110% (e.g., at least 103%) of the first distance (FIG. 4B). In this manner, a protruding feature (e.g., 106*a* or 106*b*) received between one of the one or more ledges (e.g., 102*a* or 102*b*) having a tapered surface 126 and upper surface 62*a* can be urged toward the upper surface—and thus structure 14, when body 50 is coupled thereto—which can facilitate flush mounting between the fixture and the structure.

Protruding features 106*a* and 106*b* of fixture 10 can be configured to cooperate with the one or more ledges in a manner that facilitates the above-described rotation and/or upward-urging of the fixture. For example, as described above, first protruding feature 106*a* can comprise a fastener (e.g., a screw or bolt) that is adjustable or inwardly-movable, e.g., is movable relative to base 26 between a first position and a second position in which the first protruding feature is closer to central axis 46 than when it is in the first position. When first protruding feature 106*a* is in the second position, it can resist rotation of base 26 (and thus fixture 10) relative to body 50 about central axis 46 more so than when it is in the first position (e.g., due to higher frictional forces exerted on peripheral surface 66). In this manner, base 26 (and thus fixture 10) can be rotated relative to body 50 to a desired orientation when first protruding feature 106*a* is in the first position (e.g., when the first protruding feature poses less resistance) and the first protruding feature can thereafter be moved to the second position to help maintain the fixture in the desired orientation.

Such an inwardly-movable first protruding feature 106*a* can also facilitate upward-urging when received between one of the one or more ledges (e.g., 102*a* or 102*b*) having a tapered surface 126 and upper surface 62*a*. As first protruding feature 106*a* is moved toward the second position, fixture 10 can be urged toward upper surface 62*a*, e.g., because inward movement of the first protruding feature causes it to contact—and thus move along—tapered surface 126, which yields upward movement of the first protruding feature and thus of the fixture. Second protruding feature 106*b* can also be disposed between one of the one or more ledges having a tapered surface 126 and upper surface 62*a* (e.g., ledge 102*b*), which can facilitate upward movement of the second protruding feature as the first protruding feature moves inward.

First protruding feature 106*a* can be the only one of the protruding features of fixture 10 that is inwardly-movable as described above; for example, second protruding feature 106*b*—and any other protruding features configured to be supported by the one or more ledges—can be static, i.e., coupled in fixed relation to base 26 of the fixture. In this manner, fixture 10's position relative to body 50—and thus to structure 14—can be adjusted and maintained at least in part by adjusting the position of a single protruding feature (e.g., a fastener, such as a set screw), which can promote easy installation.

Body 50 can be coupled to base 26 such that the base contains the body. For example, base 26 can define a recess 134 and, when body 50 is coupled to fixture 10, at least a portion of the body can be received by the recess. To couple fixture 10 to base 50, first and second protruding features 106*a* and 106*b* can each be configured to extend into recess 134 such that they can be supported by the one or more ledges contained in the recess.

While fixture 10, structure 14 (e.g., junction box 70), and fixture mount 18 are described above as separate components, in some embodiments the fixture, the structure, and/or any components thereof can be considered part of the fixture mount (e.g., the fixture mount can comprise the fixture and/or the structure).

Figure 7A:
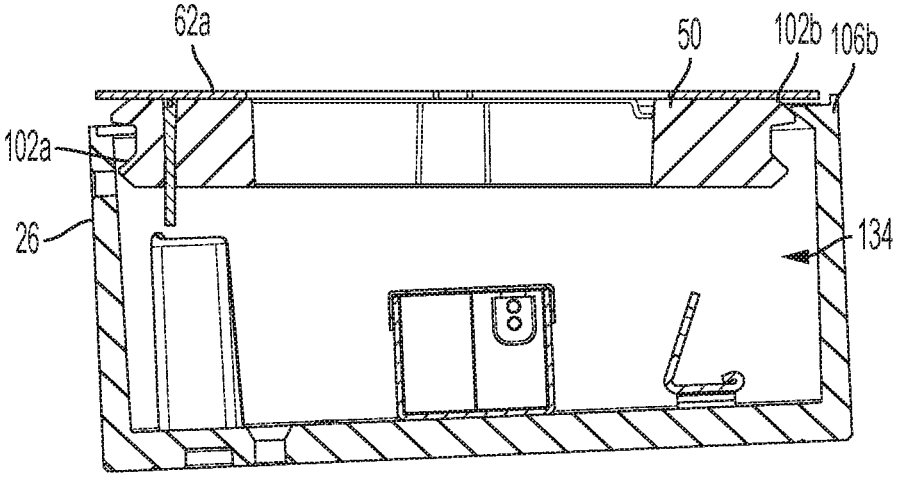
FIGS. 7A-7C illustrate one of the present methods, showing coupling of the fixture mount and the base of the fixture of FIGS. 1A and 1B to one another.
Figure 7B:
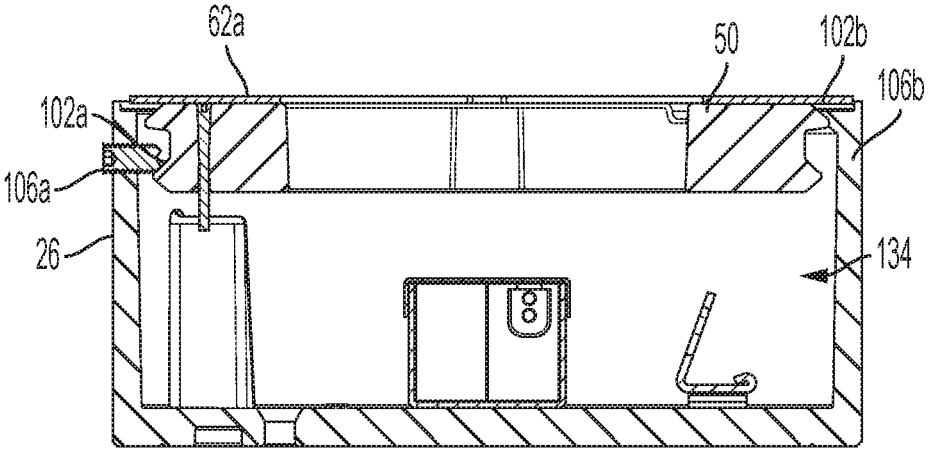
Figure 7C:
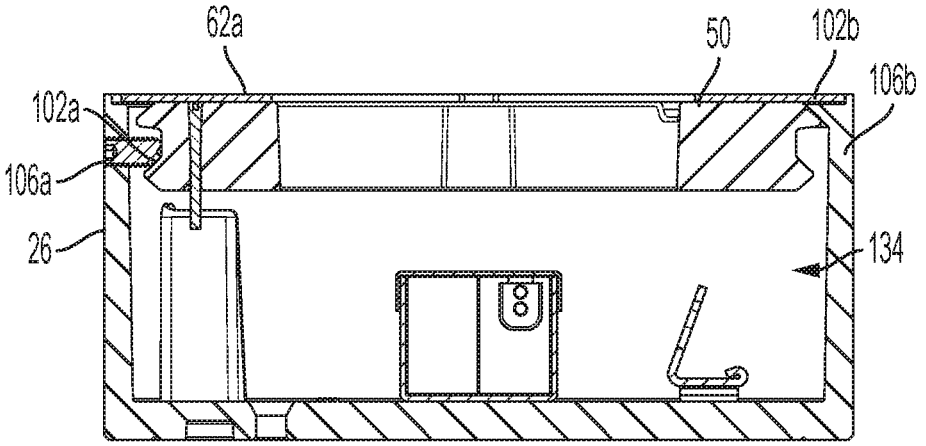

FIGS. 7A-7C illustrate some of the present methods of coupling a fixture (e.g., 10) to a structure (e.g., 14). Some methods comprise a step of coupling a body (e.g., 50)—which can be any of the above-described bodies—to the structure such that an upper surface (e.g., 62*a*) of the body faces the structure. The body can be coupled to the structure in any of the above-described manners; for example, the structure can comprise a junction box (e.g., 70) and the body can be coupled at least by inserting one or more fasteners (e.g., 82) through the body (e.g., through one or more openings 74 of the body) and into one or more openings (e.g., 78) of the junction box.

Some methods comprise a step of coupling the fixture to the body (e.g., after the body is coupled to the structure). As described above, the fixture can be coupled such that a first protruding feature (e.g., 106*a*) coupled to a base (e.g., 26) of the fixture is received between one of the body's one or more ledges (e.g., 102*a* or 102*b*) and the upper surface on a first side (e.g., 110*a*) of the body and a second protruding feature (e.g., 106*b*) that is coupled to the base is received between one of the body's one or more ledges (e.g., 102*a* or 102*b*) and the upper surface on a second side (e.g., 110*b*) of the body that is opposite the first side. The protruding features can, but need not, be disposed above the one or more ledges sequentially. For example, the second protruding feature can be disposed above one of the one or more ledges (FIG. 7A) before the first protruding feature is disposed above one of the one or more ledges (FIGS. 7B and 7C). To facilitate this sequential coupling, the first protruding feature can be movable between the first and second positions as described above. The base, once the second protruding feature is disposed above a ledge, can accordingly be positioned (e.g., tilted) unimpeded by the first protruding feature (e.g., which might otherwise engage the body during such positioning if fixed in the second position) such that the first protruding feature can be moved from the first position (FIG. 7B) toward the second position (FIG. 7C) to be received above one of the one or more ledges. The second protruding feature—which can be fixed relative to the base—can at least partially support the fixture when the first protruding feature is being disposed above the ledge.

As described above, the first and second protruding features can, but need not, be supported by different ledges: the first and second ledges, respectively. The second ledge can be disposed closer to the body's upper surface than is the first ledge; such positioning can facilitate sequential mounting of the protruding features and/or access to the first protruding feature to move it between the first and second positions. For example, disposing the second protruding feature above the second ledge can facilitate tilting of the fixture to subsequently dispose the first protruding feature above the first ledge. And disposing the first protruding feature above the first ledge yields relatively more space between the first protruding feature and the structure that the fixture is being coupled to such that a tool—such as a screwdriver or drill—can more easily access the first protruding feature to move it between the first and second positions.

Some of the present methods comprise a step of rotating the fixture relative to the body about a central axis (e.g., 46) of the body by an angle that is greater than or equal to any one of, or between any two of, 10°, 30°, 60°, 90°, 120°, 150°, 180°, 210°, 240°, 270°, 300°, 330°, 360° or 370° (e.g., at least 90°). That rotation can be performed such that the first and second protruding features slide along the one or more ledges above which they are received as discussed above. Further, that rotation can be performed while the first protruding feature is in the first position (FIG. 7B) such that the first protruding feature poses less resistance to rotation, compared to if it were in the second position. After rotating the fixture, some methods comprise moving the first protruding feature from the first position to the second position (e.g., to help maintain the fixture in place).

FIGS. 7B and 7C also illustrate how, in some methods, moving the first protruding feature from the first position to the second position can urge the fixture toward the structure when it is received above a tapered ledge (e.g., the first ledge). As shown, as the first protruding feature moves inward, it travels along the tapered surface (e.g., 126) of the first ledge, causing the first protruding feature—and thus the fixture's base through which it extends—to travel upward toward the body's upper surface and to the structure. The second protruding feature—which can have a tapered surface in contact with the tapered surface of the second ledge—can also be urged upward toward the structure as the first protruding feature moves toward the second position.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means plus- or step-plus-function limitations, unless such a limitation is explicitly recited in a given claim using the phrase(s) "means for" or "step for," respectively.

The invention claimed is:

1. A fixture mount comprising:

a body configured to be coupled to a structure, the body having:

an upper surface that faces the structure when the body is coupled to the structure;

a lower surface that is opposite to the upper surface; and a peripheral surface that:

connects the upper and lower surfaces; and defines one or more ledges, each extending around at least a portion of the body;

wherein the body is configured to be coupled to a fixture such that:

a first protruding feature of the fixture is received between one of the one or more ledges and the upper surface on a first side of a plane that includes a central axis of the body;

a second protruding feature of the fixture is received between one of the one or more ledges and the upper surface on a second side of the plane that is opposite to the first side; and the first and second protruding features are slidable along the one or more ledges above which they are received such that the fixture is rotatable relative to the body about the central axis of the body by an angle of at least 10 degrees.

2. The fixture mount of claim 1, wherein each of the one or more ledges is positioned such that a circular arc about the central axis, the circular arc overlying the ledge and subtending at least 10 degrees, does not intersect the body.

3. The fixture mount of claim 1, wherein the body is configured to be coupled to the fixture such that the first and second protruding features are slidable along the one or more ledges above which they are received such that the fixture is rotatable relative to the body about the central axis of the body by an angle of at least 90 degrees.

4. The fixture mount of claim 1, wherein at least one of the one or more ledges has a tapered surface positioned such that a distance, measured perpendicular to the central axis, between the central axis and the tapered surface increases along a direction from the upper surface to the lower surface.

5. The fixture mount of claim 1, comprising:

the fixture;

wherein the fixture has a base to which the first and second protruding features are configured to be coupled; and wherein, when the body is coupled to the fixture, the first protruding feature is movable relative to the base between a first position and a second position in which the first protruding feature is closer to the central axis of the body than when the first protruding feature is in the first position; and when the first protruding feature is in the second position, the first protruding feature resists rotation of the fixture relative to the body about the central axis of the body more so than when the first protruding feature is in the first position.

6. The fixture mount of claim 5, wherein:

the base defines a recess into which the first and second protruding features are configured to extend; and when the body is coupled to the fixture, at least a portion of the body is received by the recess.

7. The fixture mount of claim 5, wherein the fixture comprises a light fixture having an emitter housing that is coupled to the base such that, when the body is coupled to the fixture, the emitter housing is rotatable relative to the base about an axis that is perpendicular to the central axis of the body.

8. The fixture mount of claim 5, wherein the first protruding feature comprises a fastener.

9. The fixture mount of claim 5, wherein the second protruding feature is coupled in fixed relation to the base of the fixture.

10. The fixture mount of claim 1, wherein the one or more ledges comprise:

a first ledge; and a second ledge that is positioned closer to the upper surface than is the first ledge.

11. The fixture mount of claim 10, wherein the body is configured to be coupled to the fixture such that:

the first protruding feature is received between the first ledge and the upper surface; and the second protruding feature is received between the second ledge and the upper surface.

12. The fixture mount of claim 11, wherein:

at least a portion of the first ledge is disposed on the first side of the plane that includes the central axis of the body; and at least a portion of the second ledge is disposed on the second side of the plane.

13. A fixture mount comprising:

a body configured to be coupled to a structure, the body having:

a central axis;

an upper surface that faces the structure when the body is coupled to the structure;

a lower surface that is opposite to the upper surface; and a peripheral surface that:

connects the upper and lower surfaces; and defines one or more ledges, at least one of which has a tapered surface positioned such that a distance, measured perpendicular to the central axis, between the central axis and the tapered surface increases along a direction from the upper surface to the lower surface;

wherein the body is configured to be coupled to a fixture such that:

a first protruding feature of the fixture is received between one of the one or more ledges and the upper surface on a first side of a plane that includes the central axis of the body; and a second protruding feature of the fixture is received between one of the one or more ledges and the upper surface on a second side of the plane that is opposite to the first side.

14. The fixture mount of claim 13, comprising:

the fixture;

wherein the fixture has a base to which the first and second protruding features are configured to be coupled; and wherein, when the body is coupled to the fixture, the first protruding feature is:

movable relative to the base between a first position and a second position in which the first protruding feature is closer to the central axis of the body than when the first protruding feature is in the first position; and received between one of the one or more ledges having a tapered surface and the upper surface such that, as the first protruding feature is moved toward the second position, the fixture is urged toward the upper surface.

15. The fixture mount of claim 14, wherein, when the first protruding feature is in the second position, the first protruding feature resists rotation of the fixture relative to the body about the central axis of the body more so than when the first protruding feature is in the first position.

16. A method for coupling a fixture to a structure, the method comprising:

coupling a body to a structure such that an upper surface of the body faces the structure, the body including:

a lower surface that is opposite to the upper surface; and a peripheral surface that:

connects the upper and lower surfaces; and defines one or more ledges, each extending around at least a portion of the body;

coupling a fixture to the body such that:

a first protruding feature that is coupled to a base of the fixture is received between one of the one or more ledges and the upper surface on a first side of a plane that includes a central axis of the body; and a second protruding feature that is coupled to the base of the fixture is received between one of the one or more ledges and the upper surface on a second side of the plane that is opposite to the first side; and rotating the fixture relative to the body about the central axis of the body by an angle of at least 10 degrees such that the first and second protruding features slide along the one or more ledges above which they are received.

17. The method of claim 16, comprising moving the first protruding feature relative to the base of the fixture from a first position to a second position in which the first protruding feature:

is closer to the central axis of the body than when the first protruding feature is in the first position; and resists rotation of the fixture relative to the body about the central axis of the body more so than when the first protruding feature is in the first position.

18. The method of claim 17, wherein the ledge above which the first protruding feature is received is tapered such that, as the first protruding feature is moved from the first position to the second position, the base of the fixture is urged toward the structure.

19. The method of claim 17, wherein coupling the fixture to the body is performed such that:

(1) the second protruding fixture is received above one of the one or more ledges; and (2) the first protruding feature is moved from the first position toward the second position to be received above one of the one or more ledges.

20. The method of claim 16, wherein:

the structure comprises a junction box; and coupling the body to the structure comprises inserting a fastener through the body and into an opening of the junction box.

* * * * *